US005149039A

United States Patent [19]

Peterson et al.

[11] Patent Number: 5,149,039

[45] Date of Patent: Sep. 22, 1992

[54] PROTECTIVE CAGE

[75] Inventors: Bradley J. Peterson; Lonnie R. O'Keeffe, both of El Paso, Tex.

[73] Assignee: Bradley J. Peterson, El Paso, Tex.

[21] Appl. No.: 614,589

[22] Filed: Nov. 15, 1990

Related U.S. Application Data

[63] Continuation-in-part of Ser. No. 478,924, Feb. 12, 1990, abandoned.

[51] Int. Cl.[5] ..... A47F 5/00

[52] U.S. Cl. ..... 248/300

[58] Field of Search ..... 248/300, 309.1, 314, 248/342, 343; 200/42.01, 304; 362/376, 145

[56] References Cited

U.S. PATENT DOCUMENTS

| | | | |
|---|---|---|---|
| 1,453,233 | 4/1923 | Ball, Jr. | 248/343 |
| 1,471,193 | 10/1923 | Nevins et al. | 362/376 |
| 1,716,940 | 6/1929 | Woller | 248/300 |
| 1,929,689 | 10/1933 | Koebnick | 362/376 |
| 2,733,334 | 1/1956 | Cosgrove | 362/376 |
| 3,378,221 | 4/1968 | Wolar et al. | 248/343 |
| 3,565,382 | 2/1971 | Passarelli, Jr. | 248/300 |
| 3,589,660 | 6/1971 | Dunckel | 248/343 |
| 4,001,778 | 1/1977 | Ross | 362/376 X |
| 4,042,201 | 8/1977 | O'Callaghan | 248/300 |
| 4,074,341 | 2/1978 | Niederöst et al. . | |
| 4,077,593 | 3/1978 | Carratala et al. | 248/346 X |
| 4,092,641 | 5/1978 | Bellinghausen et al. . | |
| 4,199,803 | 4/1980 | Hunt, III | 362/145 X |
| 4,344,114 | 8/1982 | Denhart | 362/376 X |
| 4,426,126 | 1/1984 | DeVos et al. | 248/342 X |
| 4,441,684 | 4/1984 | Credle, Jr. | 248/300 X |
| 4,795,121 | 1/1989 | Comito | 248/300 X |
| 4,959,762 | 9/1990 | Soileau | 362/376 |
| 4,999,752 | 3/1991 | Rogers et al. | 362/376 X |

FOREIGN PATENT DOCUMENTS

| | | | |
|---|---|---|---|
| 114593 | 7/1926 | Switzerland | 362/376 |
| 2174794 | 11/1986 | United Kingdom | 362/376 |
| 2210968 | 6/1989 | United Kingdom | 362/376 |

*Primary Examiner*—Renee S. Luebke
*Assistant Examiner*—Michael J. Milano
*Attorney, Agent, or Firm*—Lowell W. Gresham; Jordan M. Meschkow; Don J. Flickinger

[57] ABSTRACT

Herein presented is a device for facilitating the installation of protective cages for smoke and heat detectors and other electrical equipment. The device includes a slotted mounting plate. The plate has a centered hole whose diameter corresponds to the diameter of the detector's ceiling base hole. The plate also has a slot which extends from the perimeter of this hole to one edge of the plate. The plate can be placed between the ceiling and the mounting base of the detector without removing the wires connecting the detector. The detector hangs suspended from the ceiling by the wires while the wires are passed through the slot of the plate. The detector is reattached to the ceiling and the plate is secured between the ceiling and the mounting base of the detector. A protective cage cover is then attached to the slotted plate.

15 Claims, 2 Drawing Sheets

PROTECTIVE CAGE

This is a continuation-in-part of application Ser. No. 07/478,924, filed Feb. 12, 1990, now abandoned.

TECHNICAL FIELD OF THE INVENTION

The present invention relates generally to protective devices for electrical equipment, such as smoke detectors.

BACKGROUND OF THE INVENTION

Modern man congregates. He assembles in buildings for worship, education, entertainment, and all kinds of other purposes. Although he builds many structures with fire resistant and retardant materials, still many materials in structures presently used will and do burn. Thus, building codes require that safety devices such as sprinklers and smoke and heat detectors be installed. Many detectors have been installed on low ceilings without protective covers. Many have been vandalized—especially those in the public schools.

A number of devices have been used in an attempt to protect the detectors. Most often a protective cover or cage is attached to the ceiling around the detector. The protective cover or cage is then itself vandalized and easily torn from the ceiling. To prevent the protective cover or cage from being easily torn from the ceiling, the cover or cage must be specifically positioned and attached to ceiling joists. Unfortunately, in installations having drop ceilings, no ceiling joists are present for secure attachment of the cover or cage. On the other hand, ceiling-mounted smoke detectors and other electrical devices are generally attached relatively securely through electrical boxes and conduit. Nevertheless, the streamline design of most detectors and their electrical connections make it difficult to secure a protective cover to the detectors.

SUMMARY OF THE INVENTION

Accordingly, it is an advantage of the present invention that an improved protective cage is provided.

Another advantage of the present invention is that the protective cage of the present invention may be securely attached to smoke detectors or other electrical devices located on dropped or lowered ceilings.

Yet another advantage is that the present invention may be installed without precisely locating a position for attaching it and without drilling holes in a ceiling.

The above and other advantages of the present invention provide a unique solution to the difficulties encountered in trying to protect a detector. Instead of attaching a protective cage to a ceiling, the present invention places and holds a slotted plate between the ceiling and the mounting base of the detector. A protective cage is attached securely to this slotted plate so that the detector is enclosed therein. The installation can be readily performed by untrained personnel without the services of a licensed fire alarm company. The plate is designed for easy installation, yet, it provides a sturdy structure for protection against vandalism.

BRIEF DESCRIPTION OF THE DRAWINGS

A more complete understanding of the present invention may be derived by referring to the detailed description and claims when considered in connection with the FIGURES, wherein like reference numbers refer to similar items throughout the FIGURES, and:

DETAILED DESCRIPTION OF THE PREFERRED EMBODIMENT

Figure 1:
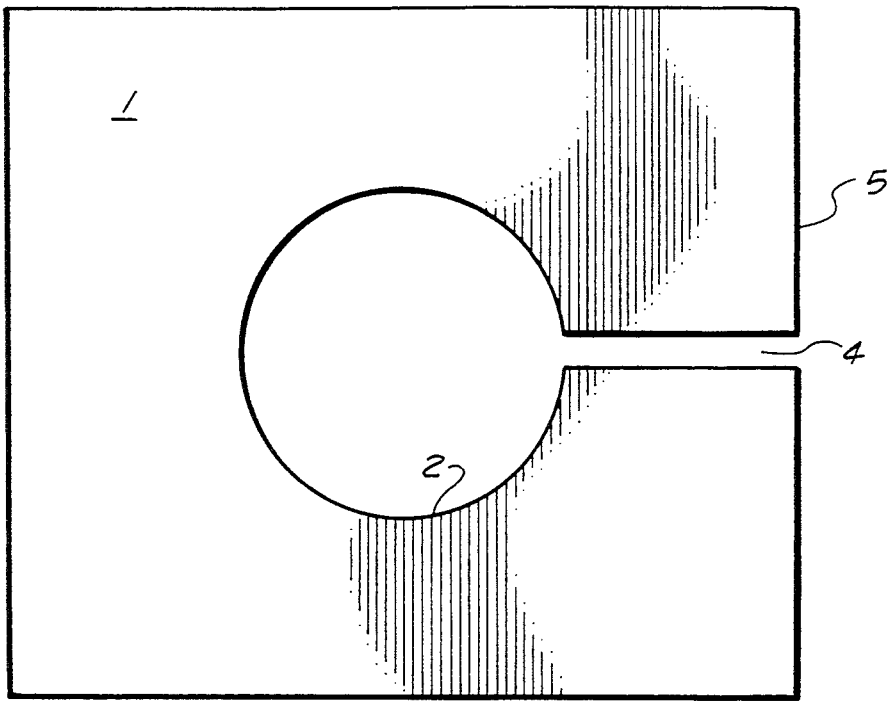
FIG. 1 is a plan overhead view looking straight down at a slotted plate portion of the present invention.
Figure 3:
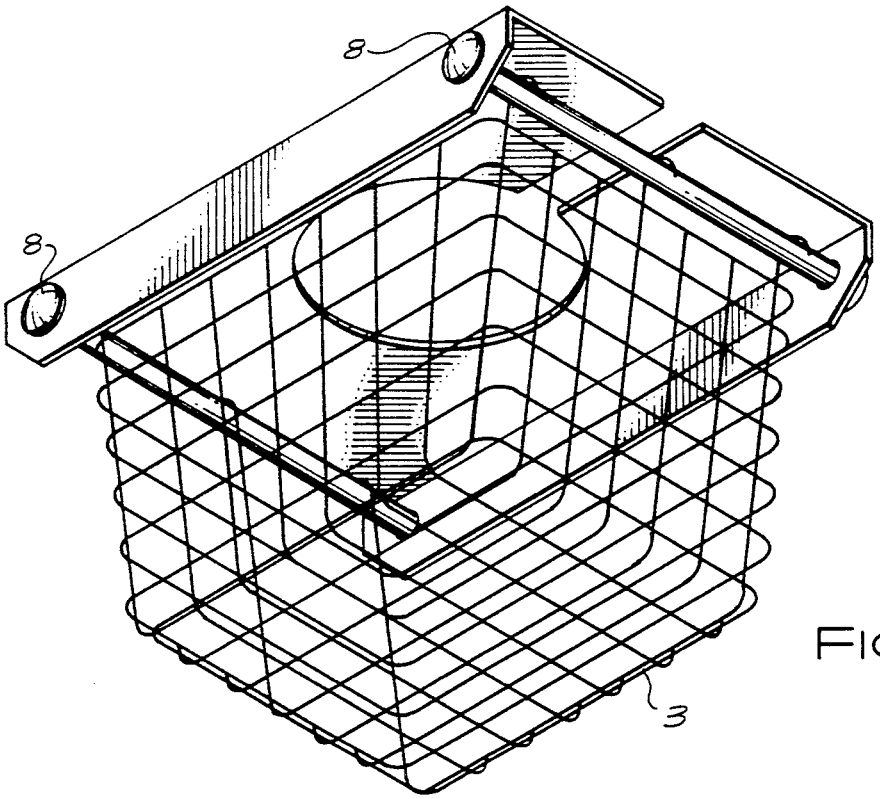
FIG. 3 is the same view as FIG. 2 where carriage bolts and cage have been attached to the slotted plate.

Turning now to the drawings and the preferred embodiments of the invention, FIG. 1 shows an overhead view of a slotted plate 1. Plate 1 has a centered hole 2 for aligning plate 1 so that a mounting base (shown below in FIG. 4) of a standard smoke detector and the detector itself will be centered in a protective cover or cage 3, as shown in FIG. 3. The plate 1 also has a slot 4 that runs from the centered hole 2 to the perimeter 5 of one of the ends of the plate. The dimensions of the slot 4 are such that will allow wires attached to a standard detector to pass through slot 4, as discussed below in connection with FIG. 4.

Figure 2:
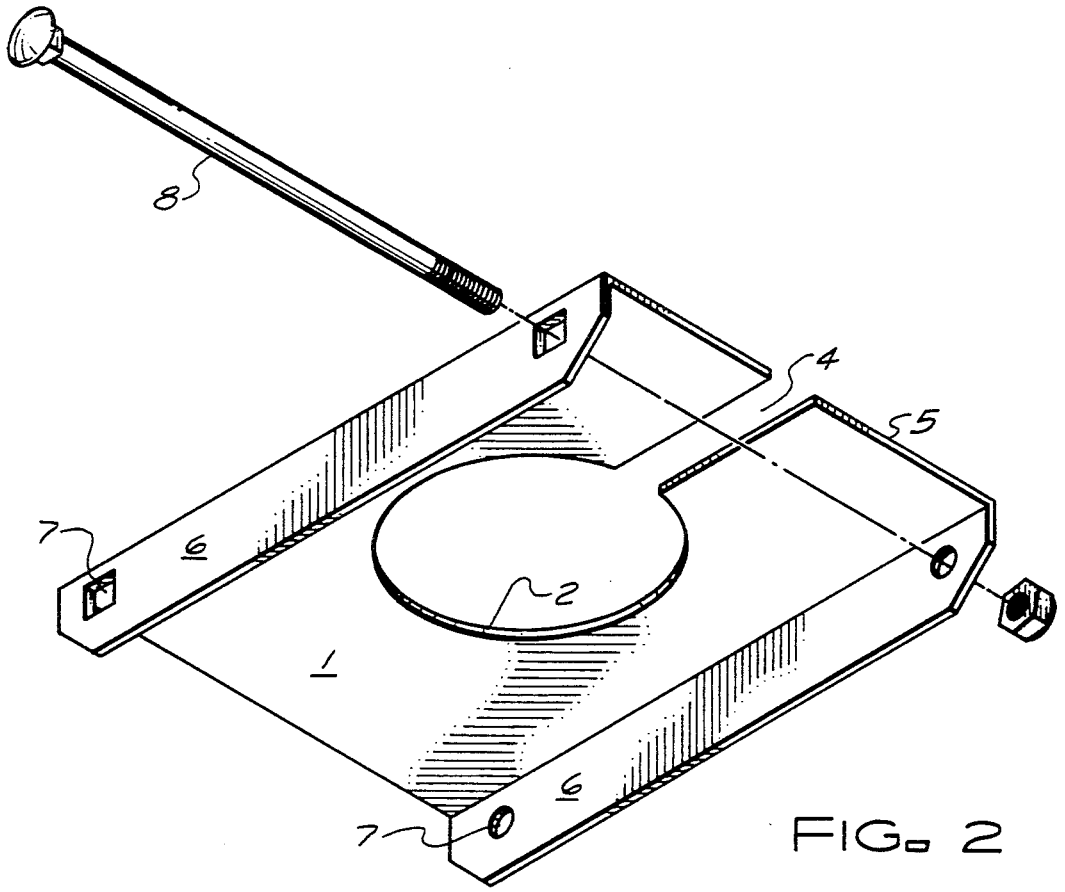
FIG. 2 is a plan view looking up at the slotted plate at an angle.

FIG. 2 shows additional features of plate 1. Plate 1 has edges 6 that run along the length sides of plate 1. The edges 6 have holes 7 for the placement of carriage bolts 8. FIG. 3 shows the carriage bolts 8 in place. The carriage bolts 8 are shown securing cage 3 to plate 1.

Figure 4:
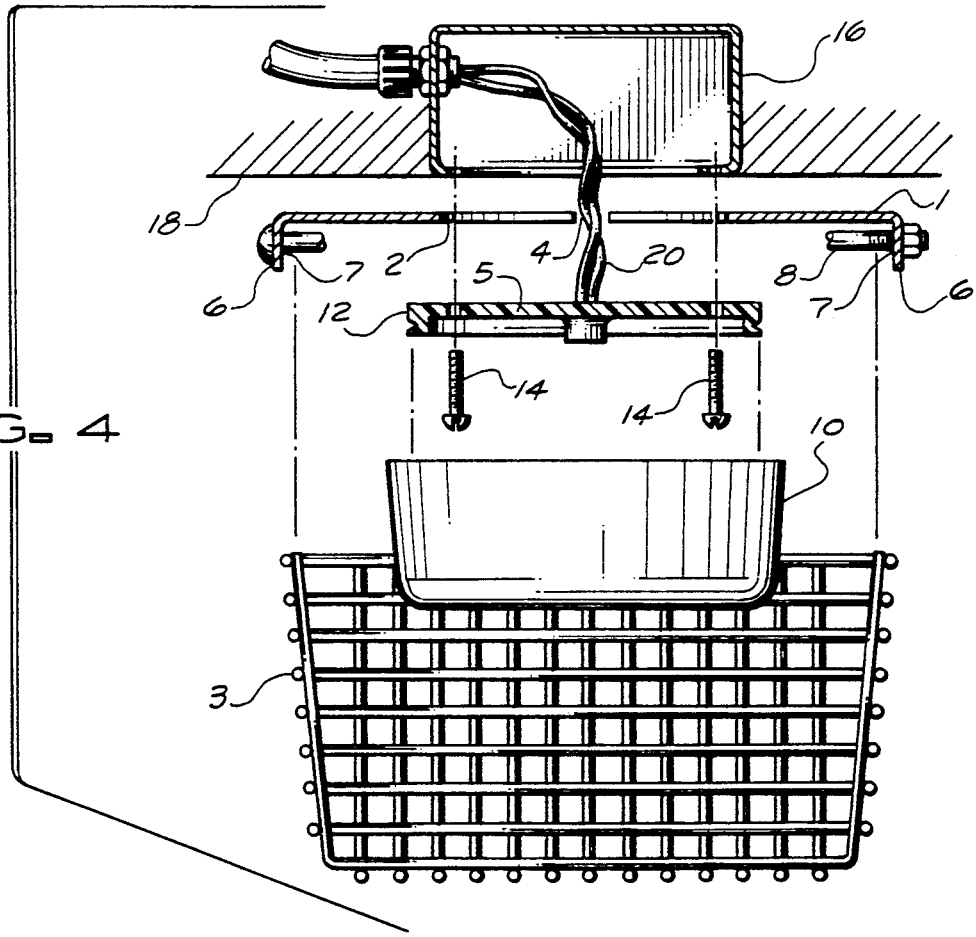
FIG. 4 is an exploded cross-sectional view of the present invention installed with respect to a standard smoke detector.

With reference to FIG. 4, in order to install the present invention relative to a standard fire detector 10, detector 10 is first detached from its mounting base 12. Then the screws 14, which attach the mounting base 12 to an electrical box 16, are loosened or removed so as to allow plate 1 to be placed between the ceiling or wall 18 and the detector's mounting base 12. The wires 20 of the detector 10 pass through the slot 4 of the plate 1 which runs from an edge 5 (see FIG. 2) of the plate 1 to a center hole 2 (see FIG. 2) in the plate 1. The mounting base screws 14 are replaced and/or tightened so that the slotted plate 1 is held tightly against the ceiling or wall 18 and the mounting base 12 of the detector 10 is secured. The diameter of hole 2 is slightly larger than the distance between screws 14. Moreover, the diameter of hole 2 is smaller than base 12. Thus, the centered hole 2 automatically centers base 12 with respect to plate 1. When screws 14 are tightened, clamping action holds plate 1 securely in place between base 12 on one side of plate 1 and ceiling 18 and electrical box 16 on the other side of plate 1. The detector 10 is completely reattached and then a protective cover 3 is placed over the detector 10. The cover 3 is attached to the slotted plate 1.

The preferred cover 3 is a cage with cross bars of adequate strength and spaced so that objects cannot get through to damage the detector but also so as not to impair the detector's functioning.

The preferred means for attaching the cage 3 to the slotted plate 1 is as follows: two of the sides of the slotted plate 1 have perpendicular edges 6. In other words, edges 6 project perpendicularly away from the general planar surface of plate 1. These edges 6 would extend out away from the ceiling or wall 18 when the slotted plate 1 is placed between the ceiling or wall 18 and the detector's mounting base 12. Cage 3 fits between edges 6. A carriage bolt 8 is attached to and runs through each end of each edge 6. The bars of the cage 3 are securely attached to the carriage bolts 8 by hooking ends of the bars of cage 3 over bolts 8 or by forming eyes (not shown) in the ends of the bars of cage 3 and threading bolts 8 through the eyes.

In summary, the present invention provides an improved protective cage. The protective cage of the present invention may be securely attached to smoke detectors or other electrical devices located on dropped or lowered ceilings. Of course, those skilled in the art will realize that the present invention is not limited to use in connection with drop ceiling-attached smoke detectors. The present invention may be installed in connection with other types of ceilings or on walls. The present invention is installed easily. No precise locating or positioning activities are required because hole 2 automatically centers the present invention. No knowledge of the location of ceiling joists is required. And, no drilling of holes in joists or other complicated attachment steps are required.

While the invention has been shown and described with reference to the preferred embodiments thereof, it will be understood by those skilled in the art that various changes in form and details may be made therein without departing from the spirit and scope of the invention.

what is claimed is:

1. An apparatus for protecting a device having a mounting base portion thereof which attaches through at least two screws to an electrical box located in a ceiling or wall, said device additionally attaching to wires extending from said electrical box, said apparatus comprising:

a mounting plate having a hole located therein, said hole having a diameter which is larger than the distance between said screws and sufficiently small so that said plate is held in place by clamping action imposed between said base portion of said device and said electrical box, and said plate having a slot extending from said hole to an exterior edge of said plate, said slot being dimensioned to accommodate said wires; and a cage attached to said plate and configured in cooperation with said plate for enclosing said device.

2. An apparatus as claimed in claim 1 wherein:

a cross-section of said hole and slot reside in a first plane; and said plate has a first and second opposing edges which extend substantially perpendicularly away from said first plane, said plate being dimensioned so that the entirety of said cage fits between said edges, and so that said edges serve to attach said cage to said plate.

3. An apparatus as claimed in claim 2 wherein:

first and second edges of said cage fit between said first and second edges of said plate, said first and second edges of said cage opposing one another;

said first and second edges of said plate are substantially parallel to one another;

each of said first and second edges of said plate has first and second holes therein;

a first bolt extends between said first and second edges of said plate through said first holes thereof and couples to a third edge of said cage; and a second bolt extends between said first and second edges through said second holes thereof and couples to a fourth edge of said cage, said third and fourth edges of said cage opposing one another and extending between said first and second edges of said cage.

4. An apparatus as claimed in claim 1 wherein:

said device is a fire detector which performs a predetermined fire detection function; and said cage is configured not to impair said functioning of said fire detector.

5. An apparatus as claimed in claim 1 wherein said hole is substantially centered in said plate to align said plate with said electrical box and said device so that said device resides substantially at the center of said apparatus.

6. An apparatus for protecting a device which mounts to an electrical box located in a ceiling or wall and which attaches to wires extending from said electrical box, said apparatus comprising:

a plate having first and second opposing edges, a hole located therein, and a slot extending from said hole to an exterior edge of said plate, wherein:

said hole and said slot are dimensioned to accommodate said wires, a cross-section of said hole and said slot resides in a first plane, said first and second plate edges extend substantially perpendicularly away from said first plane, said first and second plate edges are positioned substantially parallel to one another, and each of said first and second plate edges has first and second holes therein;

a cage having first, second, third, and fourth edges, said first and second edges of said cage opposing one another and said third and fourth edges opposing one another and extending between said first and second edges of said cage, said cage being dimensioned so that said first and second edges of said cage fit between said first and second edges of said plate, and said cage being configured in cooperation with said plate for enclosing said device;

a first bolt extending between said first and second edges of said plate through said first holes thereof and coupling to said third edge of said cage; and a second bolt extending between said first and second edges of said plate through said second holes thereof and coupling to said fourth edge of said cage.

7. An apparatus as claimed in claim 6 wherein:

at least two screws attach a mounting base portion of said device to said electrical box; and said hole in said plate has a diameter which is larger than the distance between said screws and sufficiently small so that said plate is held in place by a clamping action imposed between said base portion and said electrical box when said screws are tightened.

8. An apparatus as claimed in claim 6 wherein said hole in said plate is centrally located within said plate to align said plate so that said device resides substantially at the center of said apparatus.

9. An apparatus for providing an electrical function in a manner which resists acts of vandalism, said apparatus comprising:

an electrical device;

an electrical box located in a ceiling or wall, said electrical box supplying electrical wires to said electrical device;

a mounting plate having a hole located therein and a slot extending from said hole to an exterior edge of said plate, said slot and said hole being dimensioned to accommodate said wires, and said plate being positioned between said electrical device and said electrical box and held in place by clamping action; and a cage attachable to said plate and configured in cooperation with said plate for enclosing said device.

10. An apparatus as claimed in claim 9 wherein:

at least two screws attach a mounting base portion of said electrical device to said electrical box; and said hole has a diameter which is larger than the distance between said screws and sufficiently small so that said plate is held in place by a clamping action imposed between said base portion and said electrical box when said screws are tightened.

11. An apparatus as claimed in claim 10 wherein said hole is centrally located within said plate to align said plate so that said device resides substantially at the center of said apparatus.

12. An apparatus as claimed in claim 9 wherein:

said electrical device is a fire detector which performs a predetermined fire detection function; and said cage is configured not to impair said functioning of said fire detector.

13. An apparatus as claimed in claim 9 wherein:

a cross-section of said hole and slot reside in a first plane; and said plate has first and second opposing edges which extend substantially perpendicularly away from said first plane, said edges serving to attach said cage to said plate.

14. An apparatus as claimed in claim 13 wherein said cage is dimensioned to fit between said first and second edges.

15. An apparatus as claimed in claim 14 wherein:

first and second edges of said cage fit between said first and second edges of said plate, said first and second edges of said cage opposing one another;

said first and second edges of said plate are substantially parallel to one another;

each of said first and second edges of said plate has first and second holes therein;

a first bolt extends between said first and second edges of said plate through said first holes thereof and couples to a third edge of said cage; and a second bolt extends between said first and second edges through said second holes thereof and couples to a fourth edge of said cage, said third and fourth edges of said cage opposing one another and extending between said first and second edges of said cage.

* * * * *